US006298486B1

(12) United States Patent
Huang

(10) Patent No.: US 6,298,486 B1
(45) Date of Patent: Oct. 9, 2001

(54) UNDERGARMENT WITH BODY CONTOURING FUNCTION

(76) Inventor: Chin-Chueh Huang, c/o Daniel Robinson, PMB #1008, 1867 Ygnacio Valley Rd., Walnut Creek, CA (US) 94598

( * ) Notice: Subject to any disclaimer, the term of this patent is extended or adjusted under 35 U.S.C. 154(b) by 0 days.

(21) Appl. No.: 09/523,960

(22) Filed: Mar. 13, 2000

(51) Int. Cl.[7] ..... A41C 1/00
(52) U.S. Cl. ..... 2/78.1; 2/408; 450/7
(58) Field of Search ..... 2/78.1, 73, 79, 2/227, 67, 408, 69, 406, 400; 450/7–11, 97–99, 107, 115–118, 122–124, 126–128, 134–140

(56) References Cited

U.S. PATENT DOCUMENTS 2,468,346 * 4/1949 Rayden ..... 2/408
2,476,585 * 4/1949 Cohen ..... 2/408
2,522,009 * 9/1950 Wohlman ..... 2/408
3,205,892 * 9/1965 Hopper ..... 2/78.1
3,224,448 * 12/1965 Diebold ..... 2/408
3,398,739 * 8/1968 Marino ..... 2/408
4,637,078 * 1/1987 Southwell ..... 2/408
4,695,279 * 9/1987 Steer ..... 2/408
5,762,535 * 6/1998 Nishiyama et al. ..... 2/406

* cited by examiner

*Primary Examiner*—Gloria M. Hale
(74) *Attorney, Agent, or Firm*—A & J

(57) ABSTRACT

An undergarment having body contouring function being made from stretchable material and having stitching or seams located at the front and rear side of the undergarment. The fat of the body of the wearer is pushed toward the breast or hip such that the breast and the hip of the wearer look stiffer and larger. A zipper is provided at one lateral side of the undergarment for easy wearing of the undergarment. The bottom end of the groin is provided with two crotch linings such that when the wearer closes the two legs together, an opening will not occur and when the two legs are separated apart, an opening is formed for enabling the wearer to use toilet facilities easily without having to remove the undergarment.

1 Claim, 4 Drawing Sheets

UNDERGARMENT WITH BODY CONTOURING FUNCTION

BACKGROUND OF THE INVENTION

1. Technical Field of the Invention

The present invention is directed generally to an undergarment with body contouring function.

2. Description of the Prior Art

One of the most common cosmetic surgery to provide body contouring is by way of liposuction. However, this cosmetic surgery is only suitable to people with excessive fat in the body, and the fat cells in the body are then sucked or drawn from the area with excessive fat.

This method cannot be applied to women having a little excess of fat in the body. Additionally, for women with a small breast and with excess fat at few areas on the body, such method is not required.

Some conventional methods to provide a women with a stiff breast is by incorporating a pad into the bras that she wore, or to incorporate a pad into a pant she wore to increase the stiffness of the hip. However, the procedures of wearing are laborious and troublesome and this method cannot eliminate the formation of fat in the body. In other words, the object of body contouring cannot be achieved.

SUMMARY OF THE INVENTION

Accordingly, it is an object of the present invention to provide an undergarment with body contouring function, wherein the seams at the front and rear of the undergarment are made by stretchable material such that the seams provide a pushing force towards the breast and the hip of the wearer.

Yet another object of the present invention is to provide an undergarment with body contouring function, wherein the bottom section of the crotch lining provides an opening or a closure when the legs are separated apart or closed together. Accordingly, this allows the wear to use toilet facilities easily without having to remove the undergarment.

A further object of the invention is to provide an undergarment with body contouring function, wherein a zipper is provided to the undergarment so as to facilitate the wearing of the undergarment by the wearer.

An aspect of the present invention is to provide an undergarment having body contouring function, being made from a stretchable material and having stitching or seams located at the front and rear side of the undergarment. The fat of the body of the wearer is pushed towards the breast or hip such that the breast and the hip of the wearer look stiff and larger. A zipper is provided at one lateral side of the undergarment for easy wearing of the undergarment. The bottom end of the groin is provided with two crotch linings such that linings such that when the wearer closes the two legs together, an opening will not occur and when the two legs are separated apart, an opening is formed for enabling the wearer to use toilet facilities easily without having to remove the undergarment.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
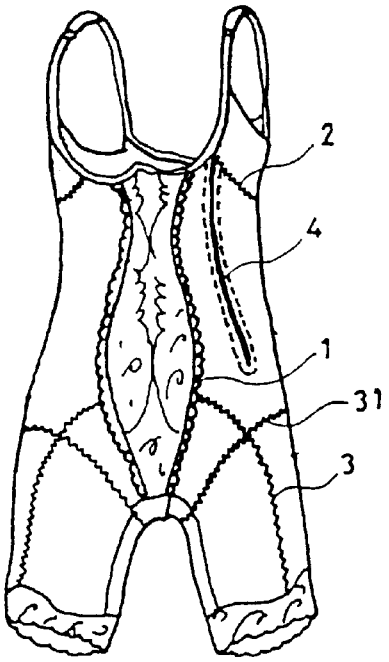
FIG. 1 is a perspective view of the front structure of the undergarment of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
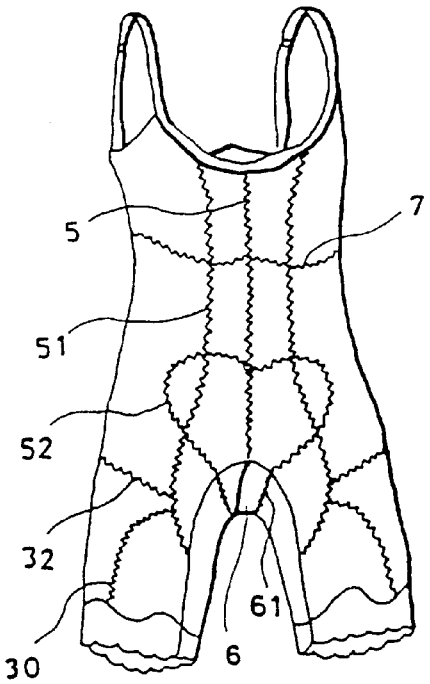
FIG. 2 is a perspective view of the rear structure of the undergarment of the present invention.

Referring to FIGS. 1 and 2, there is shown the undergarment having body contouring function, wherein the front side of the undergarment is provided with two front vertical torso seams 1 from the top end of the undergarment to the bottom end of the groin. The front vertical torso seams 1 are closer together to each other at the breast position and are further apart at the abdominal position. The seams 1 are formed into two curved lines.

Two bodice side seams 2 are extended from the lower position of the shoulder to the back section and are then formed together to form a front horizontal bodice seam 7. The leg position of the front section of the undergarment is provided with a front upper-leg seam 3 extended from the abdominal section to the leg section. A panty-line front-leg seam 31 is extended from the groin to the waist and the panty-line front-leg seam 31 is extended from the rear side of the undergarment to form the panty-line back-leg seam 32.

The center vertical back seam 5 is provided with a left vertical back seam 51 from the top end to the bottom end. The two lateral sides of the center vertical back seam 5 is provided with a left vertical back seam 51 and the two left vertical back seams 51 are extended to the position of the hip and are separated at the hip position such that the left vertical back seam 51 forms a streamline shape. The rear seam is provided with a bottom rear reinforced stitching 52 to cover the hip area. In accordance with the present invention, the bottom rear reinforced stitching 52 is a heart shape. The leg sections of the rear side of the undergarment are provided with the back upper-leg seam 30 extended from the left vertical back seam.

Figure 3:
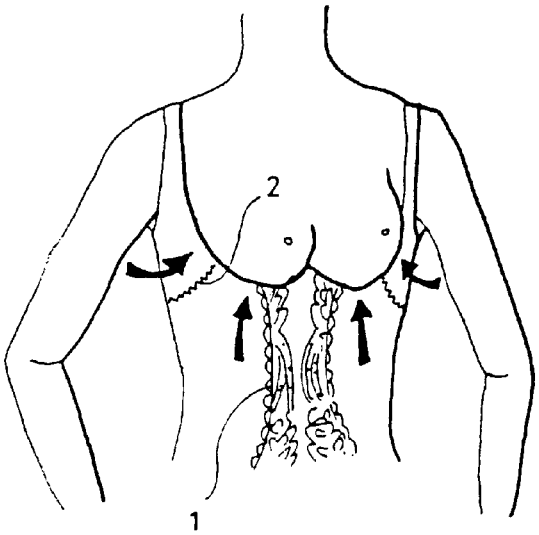
FIG. 3 is a schematic view showing body contouring of the front side of the undergarment of the present invention.
Figure 4:
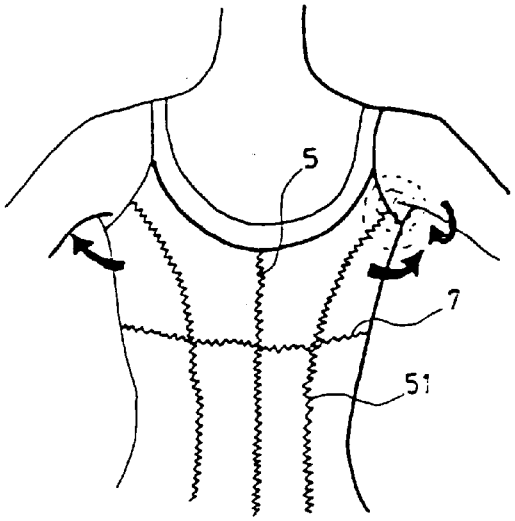
FIG. 4 is a schematic view showing body contouring of the rear side of the undergarment of the present invention.

In view of the above structure, when a lady wears the undergarment of the present invention, the bodice side seam 2 and the front vertical torso seam 1 push the body fat at the waist upward to the direction of the breast, as shown in FIG. 3, or the front horizontal bodice seam 7 and the left vertical back seam 51 push the body fat at the back and the bodice side toward the breast, as shown in FIG. 4. Accordingly, the breast of the wearer is stiffer. In addition, the body fat at the sides of the upper-leg are pushed to the hip by the front upper-leg seam 3, the back upper-leg seam 30, the panty-line front-leg seam 1, and the panty-line back-leg seam 32. By means of the bottom rear reinforced stitching 52, the upward pushed body fat maintains at that position so that the hip has a streamline shape.

Figure 6:
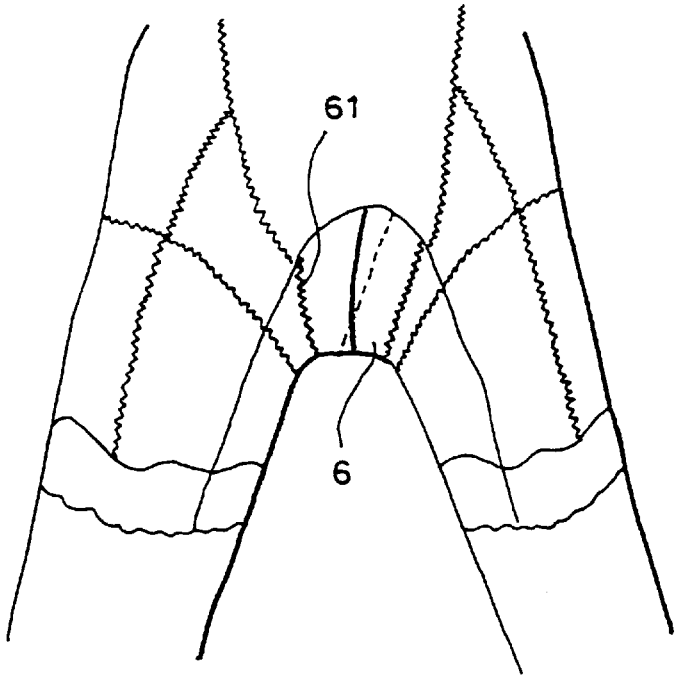
FIG. 6 schematically shows the overlapping of the crotch linings when the legs are closed together.
Figure 7:
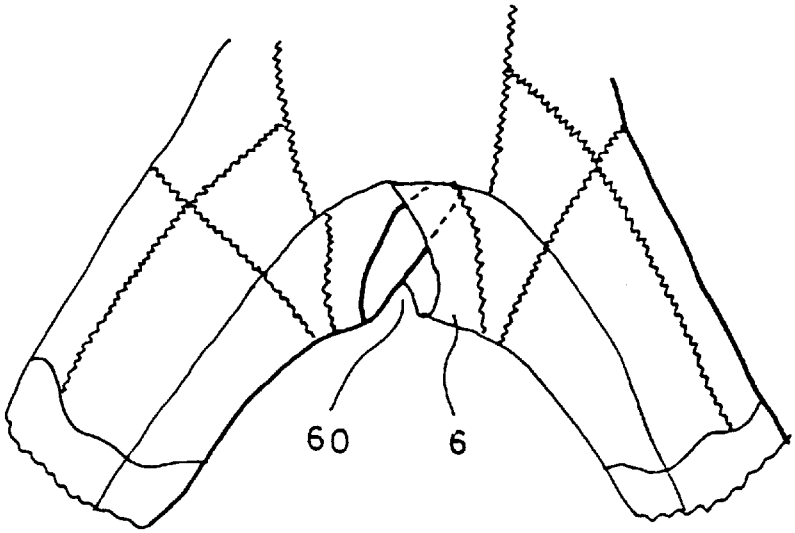
FIG. 7 schematically shows the separation of the crotch linings when the legs are separated apart, showing the formation of an opening.
Figure 8:
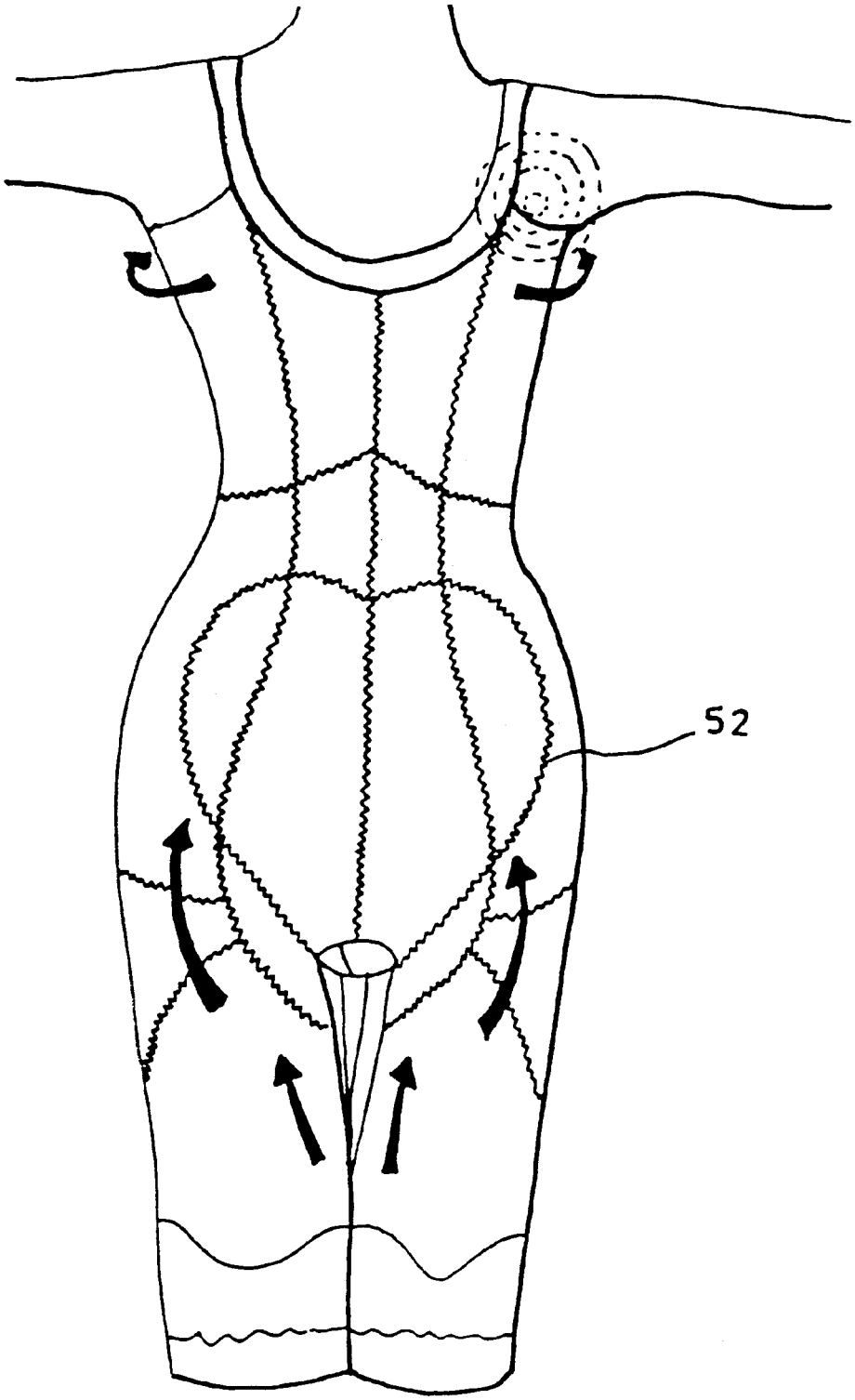
FIG. 8 schematically shows the rear structure of the undergarment of the present invention.

FIGS. 1 and 2 further disclose the crotch linings 6 at the sides of the bottom end of the groin. When the legs of the wearer close toward each other, the two crotch linings 6 overlap with each other without forming an opening (as shown in FIG. 6). When the legs are separated apart or when the wearer squats down, the two crotch linings 6 are separated from each other and formed an opening (FIG. 7). Thus, this enables the wearer to use toilet facilities easily without having to remove the undergarment.

Figure 5:
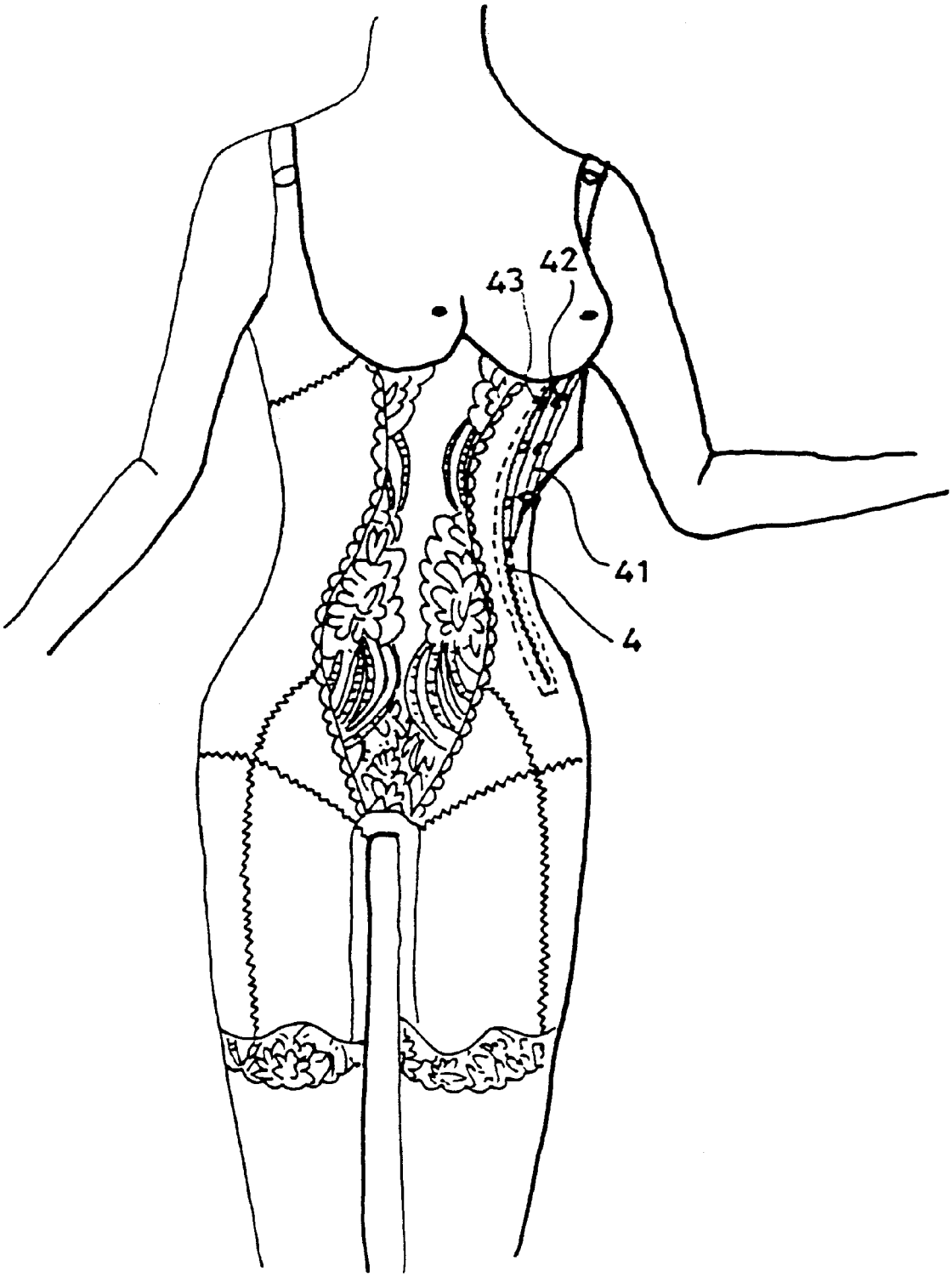
FIG. 5 shows the position of the hook and the eyelet located at the lateral sides of the zipper of the present invention.

In addition, FIG. 1 shows a zipper 4 positioned at one lateral side of the undergarment. FIG. 5 shows the location of the inner lining 41, having a hook 42 and an eyelet 43, located at the two sides of the zipper 4. In accordance with the present invention, unzipping of the zipper 4 facilitates the wearing and removing of the undergarment from the wearer. Before the zipper 4 is zipped, the hook 42 and the eyelet 43 are mounted to each other first and then the sides of the zipper 4 are pulled side by side together to avoid the teeth of the zipper 4 from dislocation.

It will be understood that each of the elements described above, or two or more together may also find a useful application in other types of methods differing from the type described above.

While certain novel features of this invention have been shows and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An undergarment with body contouring function having:a pair of crotch linings formed at two lateral sides of a lower end of a crotch of the undergarment such that when two legs of a wearer are placed together, the two crotch linings overlap with each other without forming an opening and when the two legs are separated apart or the wearer squats down, the two crotch linings are separated towards the two lateral sides and an opening is formed; wherein two front vertical torso scams are formed from a top end of the undergarment to a bottom end of the crotch of the undergarment; two lateral sides of a bodice side seam are provided from a shoulder section to a back section of the bodice side seam; wherein the bodice side seam at two lateral sides are extended from the back and then are joined to form into a front horizontal bodice seam; wherein two lateral sides of a leg section are provided with a front upper-leg seam from the crotch upward to a waist; the front upper-leg seam is extended to a rear section of the undergarment to form a panty-line back-leg seam, a center vertical back seam is formed from an upper end to a lower end of the undergarment; two corresponding sides of the center vertical back seam are provided with a left vertical back seam; a rear section of the undergarment has a bottom-rear reinforced stitching covering area of a hip; wherein lateral sides of a leg portion of a back section of the undergarment are provided with a back upper-leg seam from the left vertical back seam extended to a lower section of a rear leg section; a zipper is provided at one lateral side of a front section of the undergarment with two lateral sides of the zipper are provided with an inner lining which has a hook and an eyelet; wherein two front vertical torso seams are located close to the breast and are close to each other at the least level and are separated at an abdominal position; and wherein two left vertical back seams are separate at a hip position such that a left vertical back seam forms into a streamline L shape.

* * * * *